United States Patent [19]

Moriarty

[11] 4,135,299

[45] Jan. 23, 1979

[54] RING CUTTING TOOL

[76] Inventor: Maurice F. Moriarty, 7626 Marine Dr., Maple Grove, Minn. 55369

[21] Appl. No.: 852,671

[22] Filed: Nov. 18, 1977

[51] Int. Cl.[2] ..... B26B 17/04

[52] U.S. Cl. ..... 30/182; 30/124

[58] Field of Search ..... 30/124, 131, 179, 182, 30/183, 233, 241, 242

[56] References Cited

U.S. PATENT DOCUMENTS

| | | | |
|---|---|---|---|
| 326,327 | 9/1885 | Pickett | 30/183 |
| 1,867,342 | 7/1932 | Wieg | 30/124 |
| 2,595,145 | 4/1952 | Jensen | 30/182 |
| 2,608,748 | 9/1952 | Kirkwood | 30/124 |
| 2,614,322 | 10/1952 | Pendleton | 30/179 |
| 2,660,786 | 12/1953 | Loyd | 30/182 |

*Primary Examiner*—Jimmy C. Peters

*Attorney, Agent, or Firm*—Burd, Braddock & Bartz

[57] ABSTRACT

A tool for cutting a ring worn on the finger to effect removal of the ring from the finger. The tool includes a tool housing and a tool body movable with respect to the housing. The tool housing carries a first chisel type knife edge which is stationary during a ring cutting procedure. A second chisel type knife edge is movable with the tool body relative to the housing toward the first knife edge. A ring segment is accommodated between the knife edges where it is cut and severed. A shield is disposed between the ring bearing finger and the ring segment to be cut for the protection of the finger and to poise the ring segment preparatory to cutting. Mechanical means are provided for advancement of the knife edges toward one another to cut the ring segment.

24 Claims, 8 Drawing Figures

FIG. 1
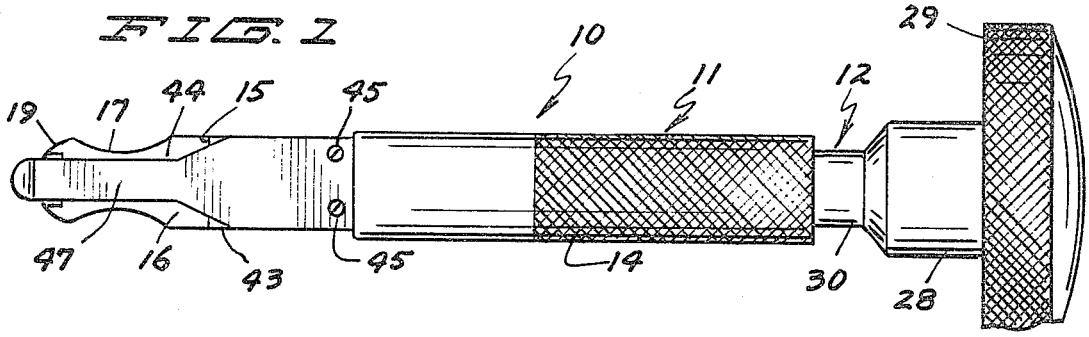
FIG. 2
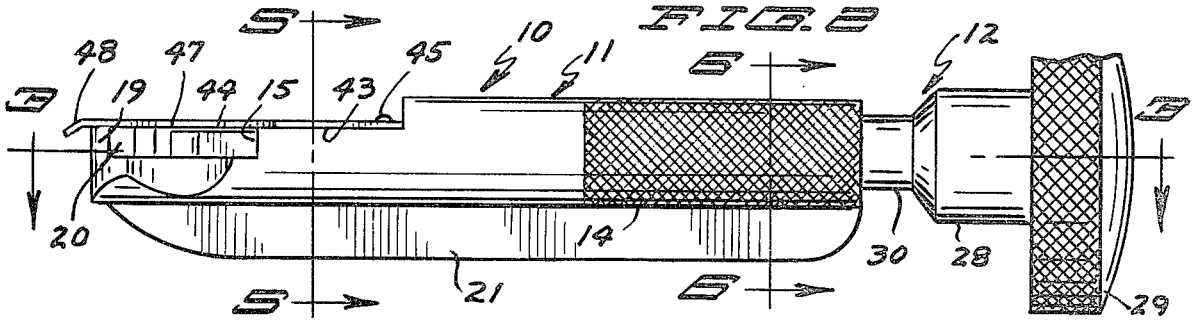
FIG. 3
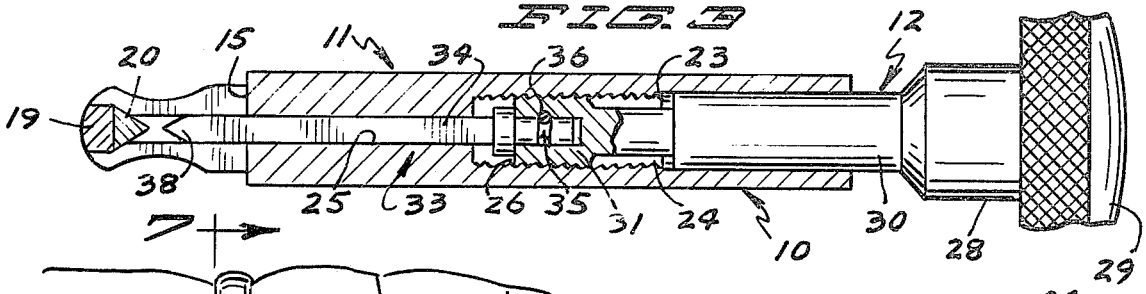
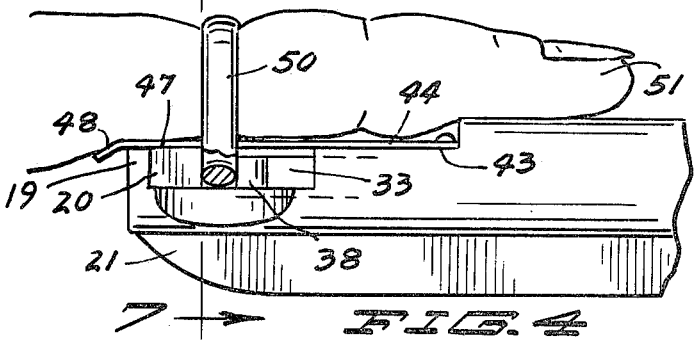
FIG. 4
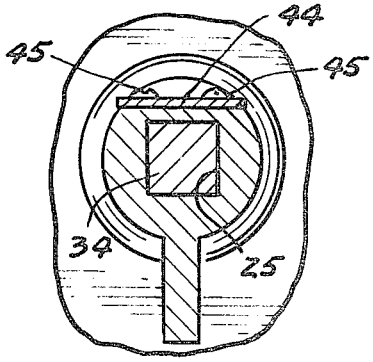
FIG. 5
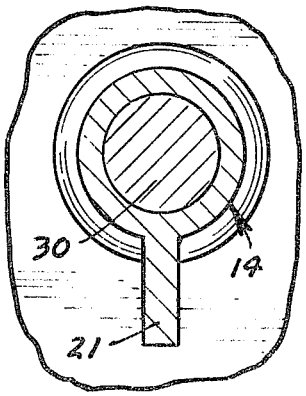
FIG. 6
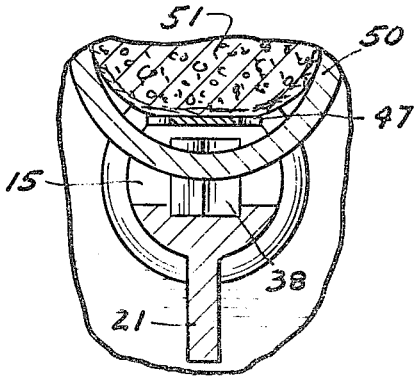
FIG. 7
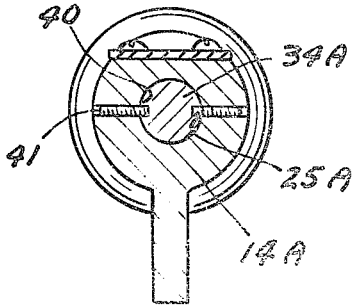
FIG. 8

RING CUTTING TOOL

BACKGROUND OF THE INVENTION

On various occasions it is required that a ring be removed from the finger of a person when the ring will not slide over the joint and top of the finger in usual fashion. This occurs, for example, when the finger is swollen due to an accident or when the ring is of too small a size and was simply forced on the finger. It is usually necessary to cut and sever the ring so that it can be bent and removed from the finger. Saws and the like tools that have been used to accomplish this create a danger to the finger and are apt to increase the pain at the ring site if it is swollen as a result of injury. One commercially available ring removal device utilizes a circular saw which is manually twisted to saw the ring while bearing toward a lever inserted between the finger and the ring segment to be cut. The sawing pressure is exerted in a direction toward the finger and can create discomfort. If there is an injury at or near the ring site, shavings from the sawed ring can enter and contaminate the wound.

SUMMARY OF THE INVENTION

The invention comprises a tool for cutting a ring worn and lodged on a finger to effect removal of the ring from the finger. The tool includes a tool housing having an elongate barrel with an axial bore disposed about a longitudinal axis. The axial bore has a first open end which opens at a first end of the housing, and a second open end which opens at an intermediate location on the housing. A first chisel type knife edge is mounted at a second end of the housing facing the second opening of the axial bore and spaced from it defining an area to accomodate a ring segment to be cut. A tool body has an elongate shaft located in the axial bore of the housing and movable therein. Preferably, the shaft has an external threaded portion which engages an interiorly threaded section of the axial bore so that axial rotation of the shaft results in advancement or retraction of the shaft with respect to the housing. The exterior end of the shaft extends out of the first end of the housing and is affixed to a handle for rotation. A cutting bit is rotatably assembled to the interior end of the shaft. The cutting bit has a shank which extends from the shaft at one end and has a second chisel like knife edge at the opposite end. Movement of the shaft inward of the housing moves the shank and second knife edge towards the first knife edge in the area defined to accommodate a ring segment to be cut. A shield extends over the cutting area and over the first and second knife edges. The shield is adaptable to be inserted between the finger of the ring wearer and the ring segment to be cut in order to protect the finger and poise the ring preparatory to cutting. The ring is cut with minimal discomfort to the ring wearer and minimal damage to the ring.

In the drawings:

FIG. 1 is a bottom plan view of a ring cutting tool according to the present invention;

FIG. 2 is a side elevational view of the ring cutting tool of FIG. 1;

FIG. 3 is a sectional view of the ring cutting tool of FIG. 2 taken along the line 3—3 thereof;

FIG. 4 is an enlarged fragmentary view of the ring cutting tool of the invention shown in engagement with a ring segment preparatory to cutting the ring for removal from a finger;

FIG. 5 is an enlarged sectional view of the ring cutting tool of FIG. 2 taken along the line 5—5 thereof;

FIG. 6 is an enlarged view of the ring cutting tool of FIG. 2 taken along the line 6—6 thereof;

FIG. 7 is an enlarged fragmentary sectional view of the ring cutting tool shown in FIG. 4 taken along the line 7—7 thereof; and FIG. 8 is a sectional view of a ring cutting tool of the invention similar to that of FIG. 5 showing a modification thereof.

DESCRIPTION OF PREFERRED EMBODIMENT

Referring to the drawings, there is shown in FIGS. 1 through 3 a ring cutting tool according to the invention indicated generally at 10. Ring cutting tool 10 is adapted to quickly and efficiently sever a ring lodged on a finger with minimal discomfort to the ring wearer and minimal damage to the ring. Ring cutting tool 10 can be used in removal of any variety of shape or size of finger ring. Tool 10 includes a tool frame or housing 11 and a tool body 12. In the normal ring cutting procedure, tool housing 11 is stationary and tool body 12 moves with respect to it to cut and sever a ring segment from a direction perpendicular to the plane of the ring.

Tool housing 11 includes at one end a tool bit guide means comprised as an elongate, generally cylindrical barrel 14 knurled at one end for gripping purposes. Barrel 14 extends from one end or the rearward end of tool housing 11 toward the opposite or forward end, terminating at a flat forward end wall 15 spaced from the forward end of tool housing 11. A flat platform 16 extends from forward wall 15 of barrel 14 to the forward end of tool housing 11 and is necked in as at 17 (see FIG. 1) to facilitate holding. An integral, upstanding support 19 extends from platform 16 at the opposite end of housing 11 in facing relationship to the forward end wall 15 of barrel 14. End wall 15, platform 17 and support 19 define a U-shaped notch or work area to accommodate a ring segment. A first chisel-type knife edge 20 is secured to the support 19 in pointing orientation toward the forward end wall 15. Alternatively, support 19 can have a flat transverse surface facing end wall 15.

An elongate rib 21 extends the length of tool housing 11 for purposes of strength and to facilitate handling.

An axial bore 23 extends the length of barrel 14 having a longitudinal axis coincidental with that of barrel 14. Axial bore 23 includes a relatively enlarged rearward portion 24 and a reduced forward portion 25. The forward portion 25 opens at the forward wall 15. The rearward portion opens to the rearward end of barrel 14 and has an internally threaded section 26.

Tool body portion 12 includes a handle 28 having a knurled knob 29 for rotation. A longitudinally orientated shaft 30 extends from the handle 28 into the axial bore 23 of barrel 14. Shaft 30 has an exteriorly threaded section 31 located in the rearward portion 24 of axial bore 23 which is in threaded engagement with the threaded section 26 of axial bore 23. Rotation of knob 29 causes advancement and retraction of shaft 30 in the bore 23 by virtue of engagement of the threaded sections 26 and 31.

A tool element or bit 33 is rotatably assembled to the end of shaft 30 for longitudinal movement with the shaft 30 in axial bore 23. Tool bit 33 includes a longitudinally orientated shank 34 which has one end rotatably assembled to the interior end of shaft 30. The end of shank 34 is located in an opening in the end of shaft 30 and has a circumferencial groove 35. A set screw 36 is threaded through the end of shaft 30 and is positioned in the groove 35 on the end of shank 34. Set screw 36 prevents the shank 34 from moving out of the opening in the end of shaft 30 but permits rotation of the shaft 30 with respect to the shank 34 of tool bit 33. Shank 34 extends from the end of shaft 30 through forward portion 25 of axial bore 23 and out of the opening of end wall 15. Shank 34 terminates in a second chisel-like knife edge 38 in opposed relationship to the first knife edge 20. The apexes of the two knife edges 20, 38 are parallel and aligned. It may be seen that advancement and retraction of the shaft 39 by rotation of knob 29 results in advancement and retraction of the second knife edge 38 relative to the first knife edge 20 in the ring cutting work area or notch defined by platform 16 and forward end wall 15 and upright support 19.

Means are provided to restrain rotation of the shank 34 in the forward portion 25 of axial bore 23. As shown in FIG. 5, the forward portion of axial bore 25 is relatively square in cross sectional shape. Likewise, shank 34 is square in cross sectional shape and fits within the forward portion 25 of axial bore 23 and is thus restrained from rotation therein by virtue of this cross sectional shape. This assures that the knife edges 20 and 38 remain in parallel relationship which is shown to be vertical in FIG. 2. Other means could be provided to restrain rotation of the shank 34 in the forward portion 25 of axial bore 23. For example, in FIG. 8 there is shown a modification wherein the shank 34A is circular in cross section and is located in a circular forward portion 25A of the axial bore. Shank 34A has longitudinal grooves 40. Set screws 41 are threaded through the side wall of barrel 14A with ends positioned in the grooves 40. The set screws 41 permit longitudinal movement of the shank 34A but prevent axial rotation. Other means could be provided to restrain axial rotation of the tool bit 33 in the forward portion of axial bore 23.

Referring again to FIG. 2, the forward end of barrel 14 is flattened on one side which is the upper side of the orientation shown in FIG. 2, providing a ledge 43. A finger shield comprised as a cantilevered resilient flat spring 44 is fastened at one end by screws 45 to ledge 43. Spring 44 has an arm 47 which extends from the ledge 43 to the upright support 19 spanning the area between front wall 15 and support 19. Arm 47 resiliently bears against support 19. Arm 47 terminates in a free end having an upwardly turned lip 48 extended slightly beyond upright support 19. Arm 47 is disposed closely adjacent to the first knife edge 20 and to the path of movement of the second knife edge 38 of tool bit 33.

In use of the ring cutting tool, as shown in FIGS. 4 and 7, a ring 50 is lodged on a finger 51 and cannot be readily removed in conventional fashion by sliding it over the joint and finger tip. It is desired to remove the ring 50 from the finger 51 with as little discomfort as possible to the ring wearer and as little damage as possible to the ring. With shank 34 of tool bit 33 retracted, the tip 48 of spring 44 is slipped between a segment of the ring 50 and the finger 51 and then moved to position shown in FIG. 4 wherein the arm 47 of spring 44 is disposed between a segment of the ring 50 and the finger 51. Ledge 43 provides a comfortable support area for the portion of the finger 51 beyond ring 50. The segment of the ring is located in the cutting area or work area defined between upright support 19, platform 16 and front wall 15 of barrel 14. With the ring segment and finger so positioned, knob 29 is turned to advance shaft 30 in axial bore 23 and thus pushing ahead tool bit 33. First and second cutting edges 20, 38 move toward one another with the ring segment disposed between them. Upon further advancement, the ring segment is cut and severed by the cutting edges 20, 38. Knob 29 and threaded portions 26, 31 provide mechanical advantage such that minimal effort is required in severing the ring segment. Once the ring segment is severed, the ring can be opened sufficiently that it can be removed easily from the finger. Tool bit 33 is retracted simply by rotating the knob 29 in the opposite direction. Alternatively, the ring can be cut at a second location to be removed in two pieces and avoid damage by bending. The removed ring is then repaired by usual ring repair procedure. During the ring cutting procedure, spring 44 serves to isolate the finger 51 from the cutting area and to poise the ring segment preparatory to cutting.

While there has been shown and described a preferred embodiment of the invention, it will be apparent to those skilled in the art that certain deviations may be had from the embodiment as shown without departing from the scope and spirit of the invention.

The embodiments of the invention in which an exclusive property or privilege is claimed are defined as follows:

1. A ring cutting tool to cut a ring segment of a ring lodged on a human finger in order to effect removal of the ring, said ring cutting tool comprising:

a tool housing;

an upright support located on the tool housing;

tool bit guide means located on the tool housing spaced from the support and defining with the support a work area in the space between the support and the guide means for accomodation of a ring segment to be cut;

a tool bit movably located in the guide means and movable into said work area toward the support;

means for movement of the tool bit;

cutting edge means secured between the tool bit and the support adaptable to cut a ring segment located in the work area between the tool bit and the support upon bearing pressure between the tool bit and the support upon movement of the tool bit toward the support; and a finger shield mounted on the tool housing extending over the work area with a fixed end fixed to the housing and a free end, said free end insertable between the finger and a ring segment to be cut located in said work area to isolate the finger from the work area during the ring cutting procedure.

2. The ring cutting tool of claim 1 wherein:

said finger shield is comprised as a resilient cantilevered flat spring.

3. The ring cutting tool of claim 2 wherein:

said guide means is comprised as a barrel section having an axial bore, said tool bit having an elongate shank with an end located in the axial bore and an opposite end extending from the axial bore into said work area.

4. A ring cutting tool of claim 1 wherein:

said cutting edge means includes a first knife edge means secured to the support in pointing orientation toward the guide means.

5. The ring cutting tool of claim 4 wherein:

said cutting edge means includes a second knife edge means located on the end of the tool bit extending into the work area, said second knife edge means orientated in pointing relationship to the first knife edge.

6. The ring cutting tool of claim 5 wherein:

said finger shield is comprised as a resilient cantilevered flat spring.

7. The ring cutting tool of claim 1 wherein:

said cutting edge means includes a knife edge on the end of the tool bit extending into the work area, said knife edge disposed in pointing orientation toward the support.

8. A ring cutting tool to cut a ring segment to remove a ring from a finger, comprising:

a tool housing having a barrel section at one end and an upright support at the opposite end spaced from the barrel section and positioned so that the space between the barrel section and the upright support defines a work area to accomodate a ring segment to be cut;

said barrel section having an axial bore with an opening in facing relationship to the upright support;

a tool body including a tool bit movably positioned in the axial bore and having an end movable with the tool bit toward the support in said work area;

a knife edge located on the tool bit end movable with the tool bit toward the support;

means for movement of the tool bit toward the support to cut a ring segment located in the work area with the ring plane positioned perpendicular to the direction of movement of the tool bit;

a finger shield mounted on the tool housing extending over the work area, said finger shield having a fixed end fixed to the housing and a free end, said free end insertable between a finger and a ring segment to be cut with said ring segment located in the work area to isolate the finger from the work area during the ring cutting procedure.

9. The ring cutting tool of claim 8 including:

a first knife edge secured to the support, said knife edge in the tool bit comprising a second knife edge in pointing orientation toward the first knife edge.

10. The ring cutting tool of claim 8 wherein:

said finger shield comprising a flat spring secured at the fixed end to the barrel section and having an arm extending over the work area, and a free end bearing against the support.

11. The ring cutting tool of claim 10 wherein:

said free end has an inwardly turned lip extending beyond the support to facilitate insertion of the arm of the finger shield between a finger and a ring segment to be cut.

12. The ring cutting tool of claim 11 including:

a first knife edge secured to the support, said knife edge in the tool bit comprising a second knife edge in pointing orientation toward the first knife edge.

13. The ring cutting tool of claim 8 wherein:

said tool bit has an elongate shank located in the axial bore, and including means to restrain axial rotation of the shank in the bore.

14. The ring cutting tool of claim 13 wherein:

said tool bit shank has a square shaped cross section and that portion of the axial bore accomodating the tool bit shank also has a square cross section.

15. The ring cutting tool of claim 8 wherein:

said tool body includes a shaft having a portion located in said axial bore and connected to the tool bit, said shaft having an end extended from the axial bore and the tool housing, said means for movement of the tool bit including a handle located on said end extended from the housing, an exteriorly threaded section on the portion of the shaft in the axial bore, said tool housing having an interiorly threaded section in the axial bore, the exteriorly threaded section of the shaft being in threaded engagement with the interiorly threaded section of the tool housing whereby axial rotation of the shaft by axial rotation of the handle effects the advancement and retraction of the tool bit relative to the support.

16. A ring cutting tool to cut a ring segment of a ring lodged on a human finger to effect removal of the ring, said ring cutting tool comprising:

a tool housing having a barrel section at a first end and an upright support at a second end;

said upright support spaced from the barrel section and positioned so that the space between the barrel section and the upright support defines a work area to accommodate a ring segment to be cut;

said barrel section having an axial bore open at a first end at the first end of the tool housing and open at a second end at the end of the barrel section facing the work area;

a tool body movably assembled in the axial bore for axial movement therein;

said tool body including an elongate tool bit located in a forward portion of the axial bore toward the second end thereof with an end movable into the work area toward the support upon axial movement of the tool body;

said tool body including a shaft located in a rearward end of the axial bore toward the first end thereof, an interior end of the shaft being connected to the tool bit and an exterior end of the shaft extending out of the axial bore at the first end of the tool housing;

handle means assembled to the end of the shaft extending out of the first end of the tool housing to effect axial movement of the shaft and tool bit toward the upright support;

a knife edge located on the end of the tool bit movable with the tool bit toward the support to sever a ring segment located in the work area with the ring plane of the ring disposed perpendicular to a line of movement of the tool bit; and a finger shield mounted on the tool housing extending over the work area, said finger shield having a fixed end fixed to the housing and a free end, said free end insertable between a finger and a ring segment to be cut with said ring segment located in the work area to isolate the finger from the work area during the cutting procedure.

17. The ring cutting tool of claim 16 including:

a first knife edge secured to the support, said knife edge on the tool bit comprising a second knife edge in pointing orientation toward the first knife edge and in parallel relationship thereto.

18. A ring cutting tool of claim 17 including:

means to restrain axial rotation of the tool bit to maintain the first and second knife edges in parallel relationship.

19. The ring cutting tool of claim 17 wherein:

said forward portion of the axial bore is square in cross section, said tool bit having an elongate shank having a square cross section to fit in the forward portion of the axial bore and thereby being restrained from rotation therein.

20. The ring cutting tool of claim 17 wherein:
said finger shield comprises a flat spring secured at the fixed end to the barrel section and having an arm extending over the work area, and a free end bearing against the support.

21. The ring cutting tool of claim 17 wherein:
said shaft has an exteriorly threaded section located in the axial bore, said axial bore having an interiorly threaded section in threaded engagement with the threaded section of the shaft whereby axial rotation of the handle effects axial movement of the tool body relative to the tool housing, said tool bit being rotatably connected to the shaft and including means to restrain axial rotation of the tool bit in the axial bore.

22. The ring cutting tool of claim 21 wherein:
said finger shield comprises a flat spring secured at the fixed end to the barrel section and having an arm extending over the work area, and a free end bearing against the support.

23. The ring cutting tool of claim 21 wherein:
said barrel section has a flat ledge adjacent the work area, said finger shield comprising a flat spring fixed at one end to the flat ledge and having an arm extending over the work area, and a free end bearing against the support.

24. The ring cutting tool of claim 23 wherein:
said free end has an inwardly turned lip extending beyond the support to facilitate insertion of the arm of the finger shield between a finger and a ring segment to be cut.

* * * * *